US009920567B2

(12) United States Patent
Jetton et al.

(10) Patent No.: US 9,920,567 B2
(45) Date of Patent: Mar. 20, 2018

(54) THRESHOLD

(71) Applicant: PEMKO MANUFACTURING COMPANY, INC., Memphis, TN (US)

(72) Inventors: Ellen Amanda Jetton, Olive Branch, MS (US); Gary Lawrence Higginbotham, Jr., Olive Branch, MS (US); Philip Anthony Goossens, Cordova, TN (US)

(73) Assignee: PEMKO MANUFACTURING COMPANY, INC., Ventura, CA (US)

( * ) Notice: Subject to any disclaimer, the term of this patent is extended or adjusted under 35 U.S.C. 154(b) by 0 days.

(21) Appl. No.: 14/215,702

(22) Filed: Mar. 17, 2014

(65) Prior Publication Data

US 2014/0259951 A1 Sep. 18, 2014

Related U.S. Application Data

(60) Provisional application No. 61/791,545, filed on Mar. 15, 2013.

(51) Int. Cl.

| | |
|---|---|
| ***E06B 1/70*** | (2006.01) |
| ***E06B 7/16*** | (2006.01) |
| ***E06B 7/23*** | (2006.01) |

(52) U.S. Cl.

CPC ..... *E06B 1/70* (2013.01); *E06B 7/16* (2013.01); *E06B 7/2309* (2013.01); *E06B 7/2316* (2013.01)

(58) Field of Classification Search

CPC . E06B 1/70; E06B 7/2316; E06B 7/16; E06B 7/22; E06B 7/23; E06B 7/2305; E06B 7/2307; E06B 7/2309

USPC ..... 49/467, 469

See application file for complete search history.

(56) References Cited

U.S. PATENT DOCUMENTS

| | | | | |
|---|---|---|---|---|
| 2,856,651 | A * | 10/1958 | Hobbs | 49/468 |
| 2,880,476 | A * | 4/1959 | Wahlfeld | 49/468 |
| 2,909,815 | A * | 10/1959 | Campo | 49/469 |
| 2,913,782 | A * | 11/1959 | Quoss | 49/469 |
| 2,933,781 | A * | 4/1960 | Cornell | 49/468 |

(Continued)

OTHER PUBLICATIONS

Pemko Assa Abloy, Pemko Catalog, 2012, downloaded from <http://www.pemko.com/assets/literature/documents/PEMKO %20Full%20Line%2010.9.2012%20FINAL.pdf> on Jan. 14, 2014, pp. CT-1-CT-26, MR-1-MR-10, DB-7.

(Continued)

*Primary Examiner* — Katherine W Mitchell
*Assistant Examiner* — Catherine A Kelly
(74) *Attorney, Agent, or Firm* — Dennis J. Williamson; Moore & Van Allen PLLC

(57) ABSTRACT

A threshold system and threshold insert for transitions through doorways. An insert for a threshold saddle to be used with a door includes an elongated member for providing a seal along a bottom edge of the door and to be received in a seat in the saddle. The insert defines a door engagement surface adapted to extend across both the seat and the change in elevation to engage the door to provide the seal. When installed for use, the door engagement surface, the saddle adjacent to the sides of the seat, or both provide an overall slope of at least or approximately 2 units horizontal to 1 unit vertical. A threshold system includes a saddle and the insert. The door or an appurtenant door shoe may have an angled surface to interface with the door engagement surface of the insert.

15 Claims, 5 Drawing Sheets

(56) References Cited

U.S. PATENT DOCUMENTS

| | | | | | |
|---|---|---|---|---|---|
| 2,963,752 | A | | 12/1960 | Peterson | |
| 3,061,896 | A | * | 11/1962 | Wahlfeld | 49/469 |
| 3,079,653 | A | * | 3/1963 | Cornell | E06B 7/2309 49/469 |
| 3,114,180 | A | * | 12/1963 | Riedl | 49/468 |
| 3,382,617 | A | * | 5/1968 | St Aubin | 49/468 |
| 4,224,766 | A | * | 9/1980 | Procton | 49/468 |
| 4,387,535 | A | * | 6/1983 | Corbo | 49/468 |
| 4,702,038 | A | * | 10/1987 | Frey | 49/478.1 |
| 4,831,779 | A | | 5/1989 | Kehrli et al. | |
| 5,001,865 | A | | 3/1991 | Procton | |
| 5,018,307 | A | * | 5/1991 | Burrous et al. | 49/471 |
| 5,029,911 | A | * | 7/1991 | Daniels | 292/170 |
| 5,283,977 | A | * | 2/1994 | Smith | 49/380 |
| 5,426,894 | A | | 6/1995 | Headrick | |
| 5,553,419 | A | | 9/1996 | Jenkins | |
| 5,673,517 | A | * | 10/1997 | Stanclift | 49/468 |
| 5,706,607 | A | * | 1/1998 | Frey | 49/478.1 |
| 6,061,967 | A | * | 5/2000 | Judds | 49/469 |
| 6,289,635 | B1 | * | 9/2001 | Procton et al. | 49/467 |
| 7,644,539 | B2 | | 1/2010 | Baxter | |
| 7,669,369 | B2 | | 3/2010 | Henry et al. | |
| 7,930,856 | B2 | * | 4/2011 | Hooper, Jr. | 49/411 |
| 8,074,699 | B2 | | 12/2011 | Jones et al. | |
| 8,276,320 | B2 | * | 10/2012 | Erbrect et al. | 49/471 |
| 8,522,483 | B2 | * | 9/2013 | Van Camp et al. | 49/469 |
| 8,739,469 | B1 | * | 6/2014 | Fortun et al. | 49/460 |
| 8,813,427 | B2 | * | 8/2014 | Meeks | 49/471 |
| 2010/0031578 | A1 | * | 2/2010 | Hartwell | 49/468 |
| 2011/0265386 | A1 | * | 11/2011 | Dunstan et al. | 49/468 |
| 2012/0210650 | A1 | | 8/2012 | Rissone | |
| 2013/0199100 | A1 | * | 8/2013 | Van Camp et al. | 49/468 |
| 2013/0199102 | A1 | * | 8/2013 | Rager-Frey | 49/469 |

OTHER PUBLICATIONS

National Guard Products, Inc., "Thresholds," 2014, downloaded from <http://www.ngp.com/ngp/cache/file/E06F10E7-F609-1BA2-F16B3615524EC8FB.pdf> on Jan. 15, 2014. pp. T1-T48.

customdoorthresholds.com. "5 in. Wide Panic Exit Aluminum Door Threshold #99067," downloaded from <http://customdoorthresholds.com/product/98-commercial-5-in-wide-panic-exit-aluminum-door-threshold-99067> on Jan. 14, 2014, pp. 1-2.

* cited by examiner

THRESHOLD

CROSS-REFERENCE TO RELATED APPLICATION

This application claims the benefit of U.S. Patent Application No. 61/791,545, entitled "Threshold," and filed Mar. 15, 2013, the entire contents of which are incorporated herein by reference.

FIELD

Aspects of the disclosure generally relate to a threshold for a doorway, and in particular may relate to a threshold and insert for providing a seal with the bottom edge of a door.

BACKGROUND

Various types of thresholds may be used to provide a seal to prevent flow of air and water beneath a door. Thresholds may include a structure that rises relative to the surrounding floor, may include a physical stop for a door, and in some cases at the exterior of a building, provides a sill and a slope away from the building to prevent inward flow of water and seepage into the building. In 2010, the United States American with Disabilities Act (ADA) regulations for the amount of rise within a threshold changed. This change had the effect of excluding from compliance with the ADA many if not all conventional bumper stops for doors at thresholds. As a result of the changes, all rises between floor surfaces should occur at or greater than a 2:1 (2 units horizontal to 1 unit vertical) slope. Therefore, a need exists for a threshold capable of a compliant, gradual slope and yet provide an effective seal to satisfy one purpose of the threshold.

SUMMARY

In accordance with one embodiment of the concepts disclosed herein, an insert for a threshold saddle to be used in conjunction with a door is provided. The insert includes an elongated member for providing a seal along a bottom edge of the door and adapted to be inserted into a seat in a threshold saddle. In use, the threshold saddle has a top surface with a first elevation on a first side of the seat and a second elevation on a second side of the seat. The elongated member defines a door engagement surface adapted to extend across the seat and between the first and second elevations to engage the door to provide the seal.

In some embodiments and in combination with the above embodiment, when seated in an installed threshold saddle, the door engagement surface provides an overall slope of approximately 2 units horizontal to 1 unit vertical, or an overall slope of greater than 2 units horizontal to 1 unit vertical. In some embodiments and in combination with any of the above embodiments, the elongated member has a substantially triangular cross-sectional shape generally formed by a base, a side extending from the base at substantially a right angle, and a hypotenuse extending between the base and the side. The elongated member is adapted to be received in the seat such that the hypotenuse defines the door engagement surface and the door engagement surface has an overall slope across the seat of at least 2 units horizontal to 1 unit vertical. In some embodiments and in combination with any of the above embodiments, when the base is horizontal, the door engagement surface has an overall slope of at least 2 units horizontal to 1 unit vertical.

In accordance with another embodiment of the concepts disclosed herein, the insert includes an elongated base extending laterally from a first edge to a second edge, an elongated wall extending in a first direction from the first edge of the base with a bottom edge to a top edge, substantially perpendicular to the base, a bearing member extending from the second edge of the base to the top edge of the wall and defining a door engagement surface. In some embodiments, the insert defines a hollow volume. When the base is substantially horizontal, the door engagement surface is at an overall angle of at least 2 units horizontal to 1 unit vertical.

In accordance with another embodiment of the concepts disclosed herein, a threshold system for a door is provided. The threshold system includes a saddle defining a seat and an insert disposed in the seat and adapted to form a seal with a bottom edge of the door. The insert having a door engagement surface positioned, when seated in an installed saddle, to have an overall slope across the seat of at least 2 units horizontal to 1 unit vertical.

In accordance with another embodiment of the concepts disclosed herein, a threshold system is provided for a mounted door where there is a floor surface on a first side of the door and a floor surface on an opposite, second side of the door. The system includes a saddle that is adapted to be disposed on the floor surface on the first side of the door at a first edge and extending to an opposite, second edge on the floor surface on the second side of the door. The saddle defines a seat having a first side proximate the first edge of the saddle and an opposite, second side proximate the second edge of the saddle. When installed, adjacent to the first side of the seat the saddle has a top surface that is at a first elevation, and adjacent to the second side of the seat the saddle has a top surface that is at a higher second elevation. An elongated insert adapted to be received in the seat for forming a seal with a bottom edge of the door, and the insert includes an angled door engagement surface such that adjacent the first side of the seat. The insert is substantially flush with the top surface of the saddle at the first elevation, and adjacent the opposite, second side of the seat, the stop is substantially flush with the top surface of the saddle at the second elevation.

In some embodiments and in combination with the above embodiment, the overall slope of the top surface of the insert, when installed, is 2 units horizontal or greater to 1 unit vertical, or may be approximately 2 units horizontal to 1 unit vertical. In some embodiments and in combination with any of the above embodiments, the slope of a line extending from the top surface of the saddle adjacent the first side of the seat at the first elevation to the top surface of the saddle adjacent the second side of the seat at the second elevation is 2 units horizontal or greater to 1 unit vertical, or may be approximately 2 units horizontal to 1 unit vertical.

In some embodiments and in combination with any of the above embodiments, the threshold system also includes a door shoe adapted to be mounted to the door. When installed, the door has a face proximate to the insert and the door shoe has an angled surface proximate to the insert. In some such embodiments, the angled surface of the door shoe is substantially parallel to the angled surface of the stop. In other such embodiments, a line parallel to the angled surface of the door shoe relative to the face of the door is between approximately 5 degrees and approximately 85 degrees.

In some embodiments and in combination with any of the above embodiments, the threshold system also includes a door wherein, when installed, the door has a face and an angled surface proximate to the insert. In some such embodiments, the angled surface of the door is substantially parallel to the angled surface of the insert. In other such embodiments, a line parallel to the angled surface of the door relative to the face of the door is between approximately 5 degrees and approximately 85 degrees.

In accordance with another embodiment of the concepts disclosed herein, a threshold system for a door is provided where there is a floor surface of a first elevation on a first side of the door and a floor surface of a second elevation that is the same as or higher than the first elevation on an opposite, second side of the door. The system includes a saddle that is adapted to be disposed on the floor surface at the first elevation at a first edge and extend to an opposite, second edge to the floor surface at the second elevation. The profile member defines a seat between the first edge and the second edge. When installed, adjacent to the first side of the seat the saddle has a top surface that is at a third elevation, and adjacent to the second side of the seat the saddle has a top surface that is at a fourth elevation. An elongated insert is received in the seat, wherein the insert includes an angled top surface such that a first side of the insert is substantially flush with the top surface of the saddle at the third elevation, and an opposite, second side of the insert is substantially flush with the top surface of the saddle at the fourth elevation.

In accordance with another embodiment of the concepts disclosed herein, a threshold is provided that includes a threshold saddle defining a seat and an insert disposed in the seat. The insert has a door engagement surface adapted to form a seal with a bottom edge of a door, and the door engagement surface is oriented, when installed for use, at an angle of other than 90 degrees relative to horizontal.

BRIEF DESCRIPTION OF THE DRAWINGS

For a more complete understanding, reference should now be had to the embodiments shown in the accompanying drawings and described below. In the drawings.

DETAILED DESCRIPTION

The following detailed description of embodiments refers to the accompanying drawings, which illustrate specific embodiments. Other embodiments having different structures and operation do not depart from the scope of the present disclosure.

Embodiments of concepts disclosed herein are directed to a threshold and threshold insert. A threshold saddle may be configured to extend, for example, across a doorway, across a change in floor material, and either between floors having the same or differing elevations. A threshold insert may be configured to have a door engagement surface that engages an edge or other portion of a door to form a seal or a general barrier between the door and the threshold, as well as to provide a physical stop for the door.

Certain terminology is used herein for convenience only and is not to be taken as a limitation on the embodiments described. For example, words such as "top", "bottom", "upper," "lower," "left," "right," "horizontal," "vertical," "upward," and "downward" merely describe the configuration shown in the figures or the orientation of a part in the installed position. Indeed, the referenced components may be oriented in any direction and the terminology, therefore, should be understood as encompassing such variations unless specified otherwise. Throughout this disclosure, where a process or method is shown or described, the method may be performed in any order or simultaneously, unless it is clear from the context that the method depends on certain actions being performed first.

In accordance with an embodiment presented herein, a stop and door interface with a stop or insert is provided at a slope to create a door stop system. The stop may provide a seal with the bottom of a door that is helpful in preventing air flow, water flow, and heat transfer under the door. In some embodiments, the insert complies with ADA requirements for slope.

Figure 1:
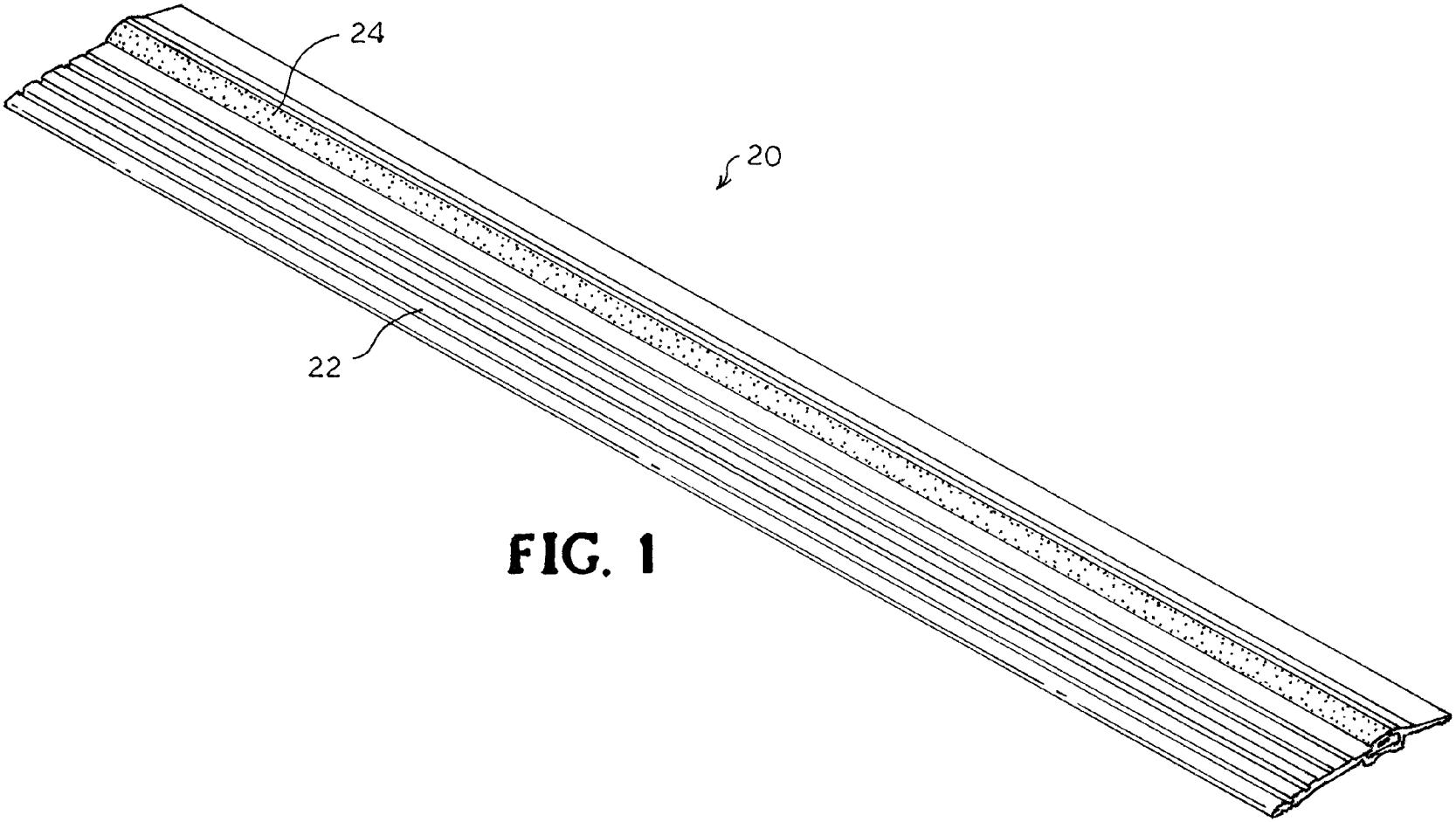
FIG. 1 is a perspective view of an embodiment of a threshold disclosed herein.
Figure 2:
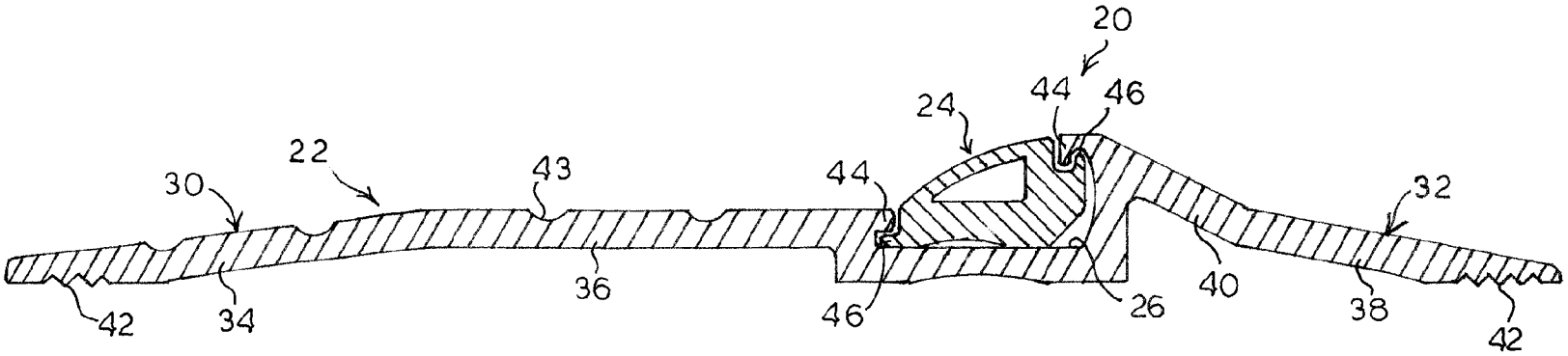
FIG. 2 is a section view of the threshold of FIG. 1 taken along line 2-2 of FIG. 1, including an embodiment of a threshold insert.

Referring to the drawings, where like reference numerals refer to the same or similar parts, FIG. 1 shows an apparatus that may be referred to as a threshold 20. The threshold 20 includes a saddle 22 and a stop or insert 24 disposed in the saddle 22. FIG. 2 shows the saddle 22 with the insert 24 disposed in a seat 26. The seat 26 runs longitudinally along the length of the saddle 22.

The saddle 22 may include sloped surfaces 30, 32 on either side of the seat. Different portions of the saddle 22 may have different slopes. For example, in the embodiment shown in FIGS. 1-5, one sloped surface 30 is defined by portions 34, 36 with differing slopes, the first portion 34 that is distal from the seat being steeper than the second portion 36 that is proximate to the seat 26. Sloped surface 32 is defined by portions 38, 40 with differing slopes, the third portion 38 that is distal from the seat being more gradual than the second portion 40 that is proximate to the seat 26. Teeth 42 may be provided on the bottom side to assist in maintaining a grip on the floor and avoiding sliding of the threshold 20. Different configurations and slopes than are shown may be provided. Treads 43 may be provided.

As shown in FIG. 2, at each side the seat 26 may include longitudinally extending protrusions or hooks 44. The insert 24 may include corresponding protrusions or hooks 46 to reciprocally receive the hooks 44 of the seat 26. In this embodiment, unless otherwise secured, such as with adhesive, the insert 24 is free to slide longitudinally within the seat 26, but is trapped or locked in place laterally with the hooks 44, 46. It may be preferable to mount the insert 24 in the seat 26 such that the insert 24 is free to slide longitudinally, as this will allow replacement of the insert 24 in case of wear and tear. In this embodiment, the seat 26 is shown generally to form a portion of a square or rectangle, but other shapes may be used.

Figure 3:
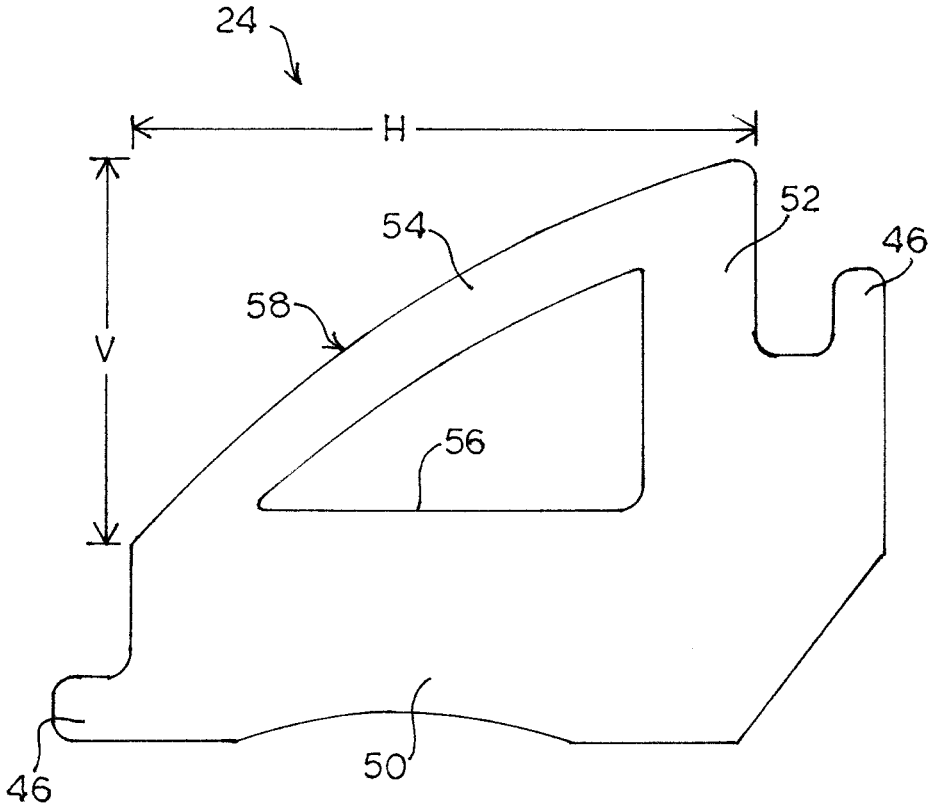
FIG. 3 is an end view of the threshold insert of FIGS. 1 and 2.

The insert 24 is shown in greater detail in FIG. 3. As shown, the insert 24 may include a base 50, a wall 52, and a bearing member 54 that define a hollow central volume 56. The base and wall may be at a substantially 90 degree to each other, and the bearing member 54 may generally be the hypotenuse between the ends of the base 50 and wall 52 that are distal from the ends where the base 50 and wall 52 meet. The bearing member 54 may have, as shown, a curved profile and a top or door engagement surface 58, in this case with a radius extending generally from where the base 50 and wall meet 52, which may help maintain an overall desired slope of the bearing member 54 when downward force is applied from a pedestrian, wheelchair, or otherwise. The door engagement surface 58 may be the exposed surface of the insert 24 when the insert 24 is disposed in the seat 26. The hollow central volume 56 may help to provide structural properties that encourage a tight seal between a door and the resilient material of the insert 26.

The insert 24 is in some embodiments formed from an elastomer, a rubber, or a resin, and may therefore deform when force is applied to it. The material may be selected to have a durometer as appropriate for the application, but in generally may be expected to have a durometer of approximately 50 to approximately 60, and in particular may have a durometer of approximately 55. Such a durometer may result in the insert 24 exhibiting desired deformation and sealing with the door when the door is closed. In the embodiment shown, the bearing member 54 is the same material as the base 50 and the wall 52, but different materials may be used to provide varying mechanical properties as desired. The saddle 22 may be made of variety of materials, whether metals or composites, but materials often used for a saddle are steel, steel alloy, or extruded aluminum.

In the embodiment of FIG. 3, the angle or slope of the door engagement surface 58 of the insert bearing member 54 is at least 2:1 (2 units horizontal H to 1 unit vertical V) or greater (more gradual) in the installed position to comply with ADA requirements. The slope of the door engagement surface 58 may be, for example, 2 units horizontal to 1 unit vertical, approximately 2 units horizontal to 1 unit vertical, or, for example, between 2 and 3 units horizontal to 1 unit vertical. Such a slope may be, for example, an average or an overall slope of the door engagement surface 58 across the seat 26, as opposed to a slope at a particular point along the door engagement surface 58, which in the embodiment shown is curved.

In one embodiment, the overall dimensions of the insert 24 may be 0.36 inch in height by 0.67 inch in width. The height of the base 50 may be approximately 0.14 inch and the thickness of the wall 52 may be 0.09 inch. The bearing member 54 may have a top surface 58 radius of approximately 1.075 inch and an inner radius of approximately 1.035 inch for a thickness of 0.04 inch.

Figure 4:
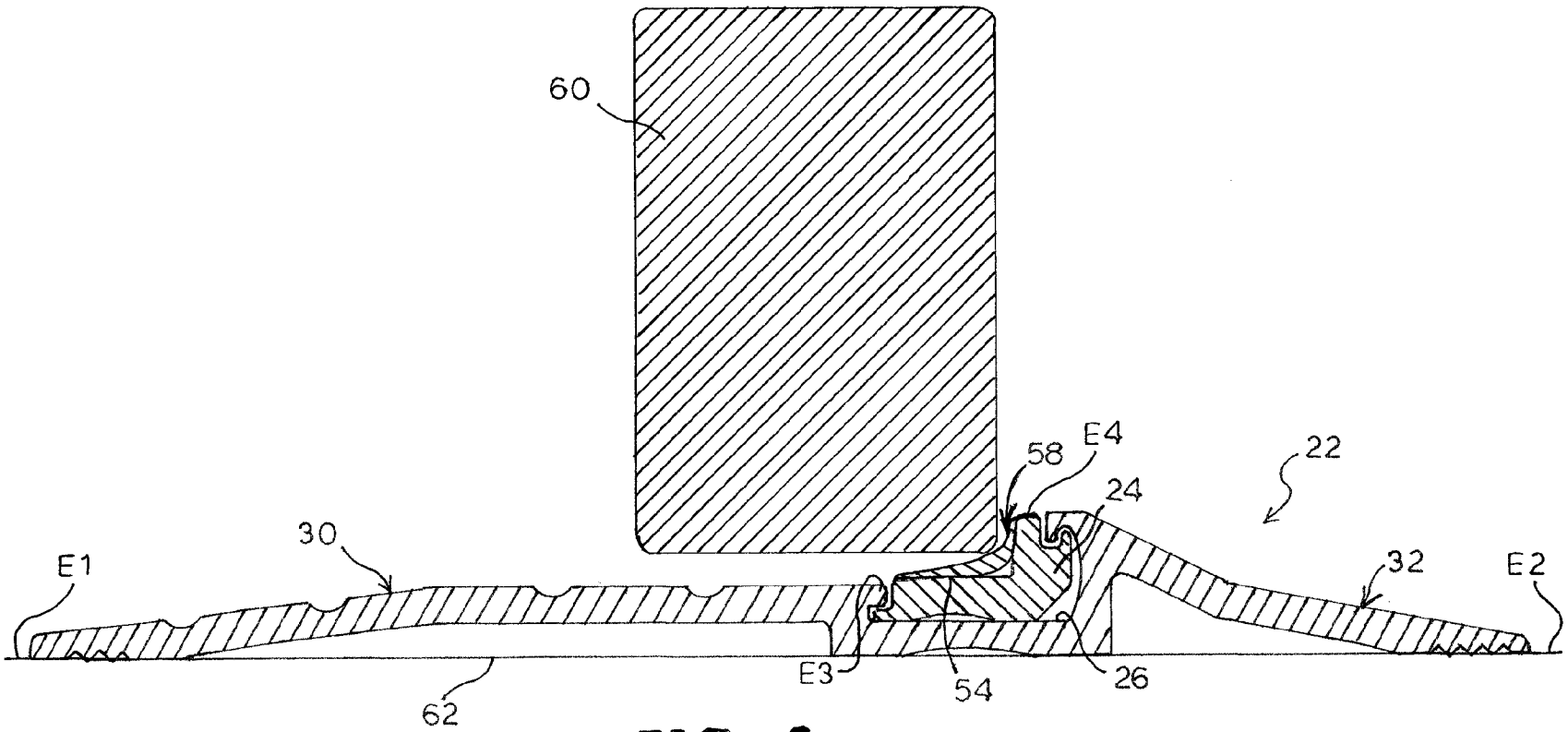
FIG. 4 is a section view of the threshold of FIG. 1 taken along line 2-2 of FIG. 1, including the embodiment of a threshold insert and also showing a door in a closed position.
Figure 5:
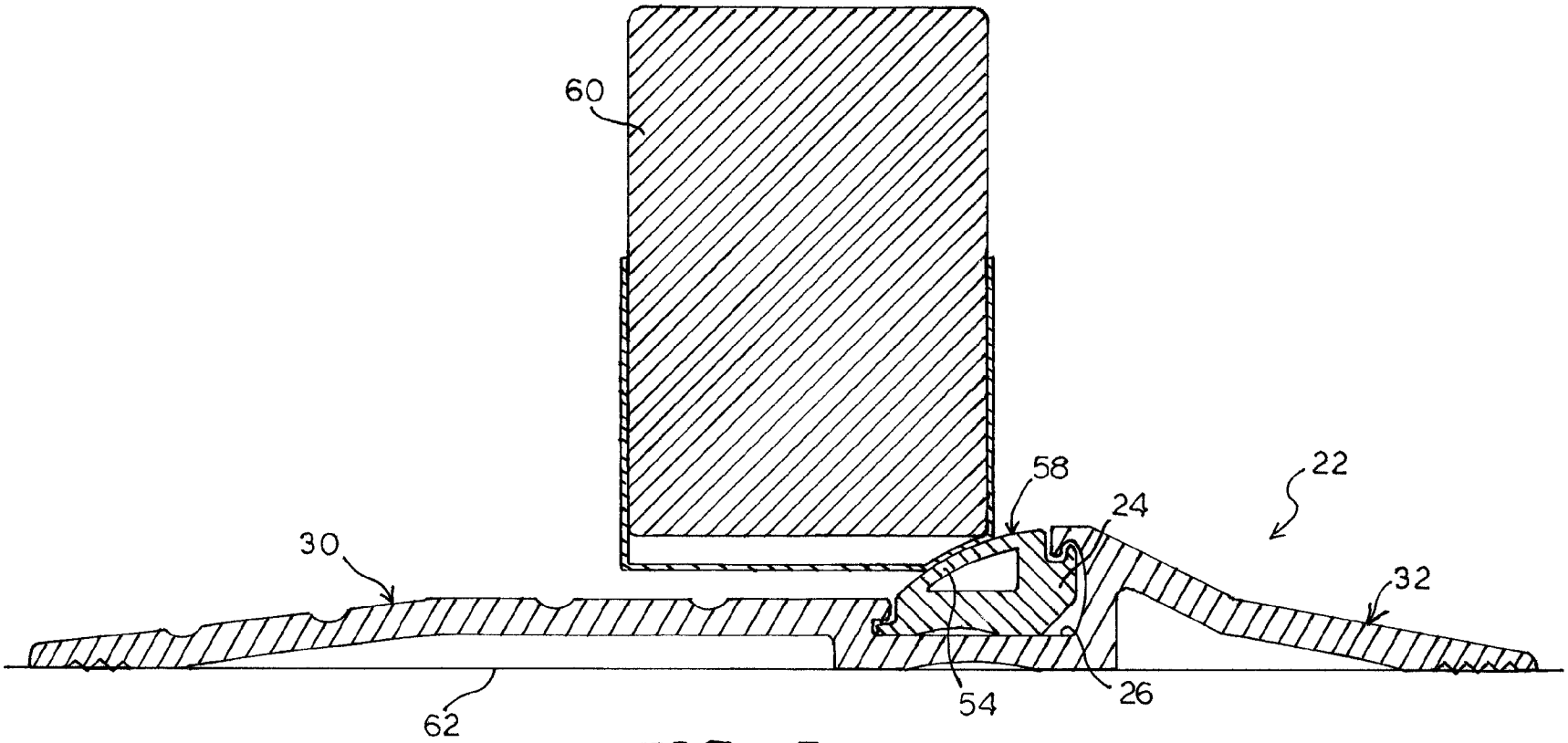
FIG. 5 is a section view of the threshold of FIG. 1 taken along line 2-2 of FIG. 1, including the embodiment of a threshold insert and also showing a door including a door shoe in a closed position.

As shown in the section view of FIG. 4, a door 60 is in the closed position above a threshold 20 that is positioned on and mounted to a floor 62. The elevation of the floor 62 on each side of the threshold 20, designated as E1 and E2, are shown to be the same, but may differ, and a threshold may accommodate this by having, for example, a more gradual slope on the surface 32 on the right at corresponding portions 38, 40 of the saddle 22. At each side the threshold 20 steps up in the direction towards the seat 26, but the portion of the threshold 20 on sloped surface 30 on the left of the door 50 is lower that the portion on sloped surface 32 on the right, as may be the case as the door 50 must pass over a part of the threshold 20.

As oriented in FIG. 4, the door engagement surface 58 is configured to be substantially flush with the surface 30 of the saddle 22 on the left edge of the seat 26, at elevation E3, and to be substantially flush with the surface 34 of the saddle 22 on the right edge of the seat 26, at elevation E4. Regardless of the deformation of the door engagement surface 58, a line from the top of the left edge of the seat 26 to the top of the right edge of the seat 26 maintains the initial slope, which may be desired to be at least 2:1.

The door engagement surface 58 may engage an edge at the bottom of the door 60 to form a seal to a degree known to one of ordinary skill in the art. The door 60 in the closed position may apply force to deform the insert 24 as shown in FIG. 4. When force is applied by the door at its corner, the bearing member 54 of the insert 24 may deflect and at least partially collapse into the hollow central volume 56. The degree to which the collapse occurs will depend on the force applied and the durometer of material of the insert 24. Desirable design characteristics may include providing a substantially continuous seal across the bottom of the door 60, retaining the desired slope (such as 2:1 or greater) when a pedestrian or wheelchair pass over the inert 24, and being resistant to wear and tear.

In an additional embodiment, a door shoe may also be provided for the door 60. As shown in the orientation and embodiment of FIG. 5, the right edge bottom corner of a door shoe 70 may have an angled surface, and that angled surface may be configured to be complementary to the angle of the door engagement surface 58 of the insert 24. The angled door shoe 70 may help to prevent wear on the rubber stop that may occur with contact in the absence of the angle, with a squared corner on the door 60. A sweep, not shown, may also be provided on the door shoe angle. In the embodiment of FIG. 2, the bottom corner of the door shoe 70 proximate to the insert 24 is angled at 2:1 or greater to match the slope of the insert top surface 58. Alternatively, the corner of the door 60 could be removed to create an angled surface. The angle of the bottom corner of the door 60 or the door shoe 70 may be angled to create threshold interface angle of, for example, from 5 to 85 degrees relative to horizontal.

While the materials of the threshold and shoe have been referred to herein as extruded aluminum and elastomer, rubber, or resin, other materials may be used instead, such as cast metal, molded plastics, machined materials, and so forth. Various door, threshold, and shoe angles may be provided. Various lengths of shoes, stops, and angles may be provided along the width of the interface. Elastomer, rubber, or resin bumpers may be applied to on one or all of the door, shoe, or threshold.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein. While the foregoing is directed to embodiments of a threshold and threshold insert, other and further embodiments may be devised without departing from the basic scope thereof, and the scope thereof is determined by the claims that follow.

What is claimed is:

1. An insert for a threshold saddle to be used in conjunction with a door including opposed major side surfaces and a top edge, a bottom edge and side edges extending between and interconnecting the side surfaces, a first one of the side surfaces forming a bottom corner with the bottom edge, the bottom corner facing the threshold saddle as the door is moved to a closed position, the threshold saddle comprising a top surface defining a seat comprising a first hook and a second hook, the first hook being spaced across a width of the saddle from the second hook, the first hook being disposed at a first elevation and the second hook being disposed at a second elevation where the second elevation is higher than the first elevation, the insert comprising:

a flexible resilient elongated member adapted to be inserted into the seat in the threshold saddle, the elongated member comprising a third hook that engages the first hook and a fourth hook that engages the second hook such that the insert is locked in position laterally relative to the saddle, the insert further comprising a door engagement surface having a first end adjacent to the third hook and a second end adjacent to the fourth hook where the engagement surface has an overall slope across the seat of at least about 2 units horizontal to 1 unit vertical such that the engagement surface slopes upwardly from the first end toward the second end such that the engagement surface is at an angle of about 27 degrees or less relative to the top surface of the threshold saddle, wherein the door engagement surface engages the bottom corner of the door when the door is in the closed position.

2. The insert of claim 1, wherein the elongated member has a substantially triangular cross-sectional shape generally formed by a base, a side extending from the base at substantially a right angle, and a hypotenuse extending between the base and the side, wherein the elongated member is adapted to be received in the seat such that the hypotenuse defines the door engagement surface.

3. The insert of claim 2, wherein when the base is horizontal, the door engagement surface has an overall slope of at least about 2 units horizontal to 1 unit vertical.

4. A threshold system for a door including opposed major side surfaces and a top edge, a bottom edge and side edges extending between and interconnecting the side surfaces, a first one of the side surfaces forming a bottom corner with the bottom edge, the bottom corner facing the threshold system as the door is moved to a closed position, the threshold system comprising:

a saddle having a longitudinal axis and comprising a top surface defining a longitudinally extending seat, the seat comprising a first hook extending along the longitudinal axis and a second hook extending along the longitudinal axis, the first hook being spaced across a width of the saddle from the second hook, the first hook being disposed at a first elevation and the second hook being disposed at a second elevation where the second elevation is greater than the first elevation; and a flexible resilient insert supported in the seat comprising a third hook that engages the first hook and a fourth hook that engages the second hook such that the insert is locked in position laterally relative to the saddle, the insert further comprising having a door engagement surface having a first end adjacent to the third hook and a second end adjacent to the fourth hook where the engagement surface has an overall slope across the seat of at least 2 units horizontal to 1 unit vertical such that the engagement surface slopes upwardly from the first end toward the second end such that the engagement surface is at an angle of about 27 degrees or less relative to the top surface of the threshold saddle, wherein the door engagement surface engages the bottom corner of the door when the door is in the closed position.

5. A threshold system for a mounted door including a first major side surface and a second major side surface, a top edge, a bottom edge and side edges extending between and interconnecting the first and second major side surfaces, the first major side surface forming a bottom corner with the bottom edge, the bottom corner facing the threshold system as the door is moved to a closed position, the threshold system comprising:

a saddle having a first edge and an opposite second edge and a top surface extending between the first edge and the second edge such that the first edge is on the first major side surface of the door and the second edge is on the second side of the door when the door is in the closed position, wherein the saddle defines a seat between the first edge and the second edge of the saddle, the seat comprising a first side defining a first hook and a second side defining a second hook, the first hook being spaced across a width of the saddle from the second hook such that the first hook is disposed closer to the first edge than the second hook, the first side being disposed at a first elevation and the second side being disposed at a second elevation where the second elevation is greater than the first elevation; and a flexible resilient elongated insert supported in the seat comprising a third hook that engages the first hook and a fourth hook that engages the second hook such that the insert is locked in position laterally relative to the saddle, the insert further comprising having an angled door engagement surface having a first end adjacent to the first side and a second end adjacent to the second side where the door engagement surface angles upwardly from the first end toward the second end, the angled door engagement surface having an overall slope defining an angle of about 27 degrees or less relative to the top surface of the threshold saddle at the first side, the angled door engagement surface engaging the bottom corner of the door when the door is in the closed position for providing a seal between the door and the saddle and a physical stop for the door.

6. The threshold system of claim 5, wherein the overall slope of the angled door engagement surface is 2 units horizontal or greater to 1 unit vertical.

7. The threshold system of claim 5, wherein the overall slope of the angled door engagement surface is approximately 2 units horizontal to 1 unit vertical.

8. The threshold system of claim 5, wherein the overall slope of a line extending from the first elevation to the second elevation is approximately 2 units horizontal or greater to 1 unit vertical.

9. The threshold system of claim 5, wherein the overall slope of a line extending from the first elevation to the second elevation is approximately 2 units horizontal to 1 unit vertical.

10. The insert of claim 1, further comprising a door shoe mounted to the door, the door shoe having an angled surface that is positioned to abut the door engagement surface when the door is in the closed position.

11. The insert of claim 10, wherein the angled surface of the door shoe is substantially parallel to the overall slope of the door engagement surface when the door is in the closed position.

12. The insert of claim 10, wherein the angled surface of the door shoe is at an angle relative to the first one of the major side surfaces of the door is between about 5 degrees and about 85 degrees.

13. The threshold system of claim 5, further comprising a door shoe mounted to the door, the door shoe having an angled surface that is positioned to abut the door engagement surface when the door is in the closed position.

14. The threshold system of claim 13, wherein the angled surface of the door shoe is substantially parallel to the overall slope of the door engagement surface when the door is in the closed position.

15. The threshold system of claim 13, wherein the angled surface of the door shoe is at an angle relative to the first major side surface of the door is between about 5 degrees and about 85 degrees.

* * * * *